United States Patent [19]

Smilges et al.

[11] 4,338,856

[45] Jul. 13, 1982

[54] DUAL PILOT COUNTERBALANCE VALVE

[75] Inventors: Robert Smilges, Columbus, Ohio; Richard Wigmore, Brighton, England

[73] Assignee: Abex Corporation, New York, N.Y.

[21] Appl. No.: 164,484

[22] Filed: Jun. 30, 1980

[51] Int. Cl.[3] ..... F15B 13/00

[52] U.S. Cl. ..... 91/420; 60/460; 137/492.5; 137/599

[58] Field of Search ..... 137/488, 492, 492.5, 137/489, 599; 91/420; 60/460

[56] References Cited

U.S. PATENT DOCUMENTS

| | | | |
|---|---|---|---|
| 3,124,343 | 3/1964 | Williamson | 137/489 X |
| 3,294,111 | 12/1966 | Abercrombie | 137/492 |
| 3,478,777 | 11/1969 | Brent | 137/492.5 |
| 3,896,844 | 7/1975 | Schumacher | 137/488 |
| 4,172,466 | 10/1979 | Pattarini | 137/488 |

*Primary Examiner*—Alan Cohan

*Attorney, Agent, or Firm*—Thomas S. Baker, Jr.; David A. Greenlee

[57] ABSTRACT

A counterbalance valve for controlling the flow of fluid from a hydraulic motor when a load is lowered has a pilot operated valve which modulates the flow of pressure fluid to and from a control port connected to main valve poppet to thereby set the opening of the poppet.

3 Claims, 3 Drawing Figures

DUAL PILOT COUNTERBALANCE VALVE

BACKGROUND OF THE INVENTION

1. Field of the Invention

This invention relates to a counterbalance valve which controls the supply of fluid to and from a fluid operated motor which raises, lowers and supports a load.

2. Description of the Prior Art

In its simplest form, the function of a counterbalance valve can be achieved by a circuit which incorporates a relief valve and a check valve which are connected in parallel to the load raising side of a fluid operated motor. The relief valve is set somewhat above the maximum desired system pressure. The check valve permits the free flow of pressure fluid to the fluid motor when the load is lifted, but closes when the load is stationary or lowered. To lower the load, fluid is supplied to the load lowering side of the motor to reverse the motor so that the sum of the force of the load and the force of the fluid acting to reverse the motor exceeds the setting of the relief valve and the load is lowered. A problem with using a relief valve in parallel with a check valve is that, if there is no load, fluid at a pressure above the setting of the relief valve must be supplied to drive the motor in reverse. This represents a great deal of wasted energy.

One way in which to lessen the energy lost in operating an unloaded fluid motor controlled by a relief valve in parallel with a check valve is to use a pilot operated relief valve which has an integral check valve. Such a valve has an adjustable spring which acts on one end, which has a small area, of a two-area spool to set the maximum system pressure. The load raising side of the motor is connected to the opposite end of the spool and the pressure fluid acts on the same area to oppose the spring. When the load is raised, fluid flows past the check valve to operate the fluid motor. When the load is lowered, a portion of the fluid in the load lowering side of the motor is directed to a pilot port connected to a larger area on the spool which acts in conjunction with the load pressure on the small area to move the spool against the spring to release the fluid from the opposite side of the motor. If there is no load on the motor, the amount of fluid pressure required to open the valve to drive the fluid motor in the load lowering direction is the maximum system pressure divided by the ratio of the spool areas.

If the ratio of the areas is 3:1, the pressure of the fluid directed to the pilot port must be one-third of the maximum system pressure set by the spring. This still represents a great deal of lost energy.

The aforementioned pilot operated relief valve is normally controlled by a four-way, open-center (all ports to tank) type valve with a throttling spool. To raise a load the valve port connected to the load lowering side of the motor and the pilot stage of the valve is open to tank and the valve port connected to the load raising side of the motor is open to pressure. To lower the load, the port connections are reversed.

A problem arises if it is desired to lower the load slowly. In order to lower a load slowly with an open-center throttling spool, the lever is moved such that pressure is supplied simultaneously to the load lowering side of the motor and to tank. The proportion of fluid to the load lowering side is gradually increased until the pressure fluid in the pilot stage is sufficient to move the spool and the motor can operate. If the load falls too fast, the pressure in the pilot stage falls, and the setting of the counterbalance valve is raised which stops the load from lowering. Since a pressure controlled counterbalance valve is a fast response valve, the valve starts and stops rapidly with the result that severe shocks are imposed on the hydraulic system, particularly when a heavy load is being lowered. Consequently, it can be seen that attempting to simultaneously control the pressures to a pilot operated relief valve by a four-way, open-center type valve is difficult and results in an unsatisfactory operation of the relief valve when a heavy load is being lowered.

One type of counterbalance valve which overcomes some of the problems mentioned above which occur when a heavy load is being lowered is shown in U.S. patent application Ser. No. 3,165, which is assigned to the assignee of the instant invention. The valve is used in a system in which a motor is driven in one direction to raise the load and in another direction to lower the load. Flow of fluid to the motor from a pump is controlled by a four-way valve. The counterbalance valve has a pilot operated metering spool with a variable orifice which passes fluid from the motor when a load is lowered and a pressure compensator piston which maintains a fixed pressure differential across the orifice to maintain a fixed fluid flow through the metering orifice for a set metering spool position. This arrangement maintains a constant rate of descent for a heavy load.

Although the counterbalance valve shown in Application Ser. No. 3,165 is a significant improvement over existing counterbalance valves, the valve is unable to prevent some jerkiness during changes in the pressure of the pilot fluid. This jerkiness occurs because the valve tries to respond instantly to each change in pressure of the pilot fluid which results in a loss of stiffness in the system.

It is desirable to have a pilot-operated counterbalance valve which is relatively insensitive to minor changes in pilot pressure which results in a stiffer system.

SUMMARY OF THE INVENTION

The instant invention relates to a counterbalance valve used in a system which uses a hydraulic motor to raise and lower a load. The motor is driven in one direction to raise the load and in the other direction to lower the load. Flow of fluid from a pump to the motor is controlled by a four-way valve.

In the instant counterbalance valve, a pilot-operated spool controls the setting of a control poppet. The pilot spool operates as a closed-center type valve. It has a land which moves relative to a control passage connected to the top of the poppet to control the ingress and egress of fluid from the top of the poppet to thereby adjust the opening of a control orifice. One side of a pilot spool land is connected to fluid at the inlet of the counter-balance valve and the other side is connected to the fluid at the outlet of the counterbalance valve.

The pilot spool land is overlapped with respect to the control passage. This means that some movement of the pilot spool due to changes in the pilot fluid pressure can occur without having the land uncover the control passage. Consequently, the overlapped control land dampens the movement of the poppet, since small changes in pilot fluid pressure do not result in changes in the setting of the poppet. An integral relief valve eliminates momentary high pressure surges in the hydraulic system.

DESCRIPTION OF THE PREFERRED EMBODIMENT

Figure 1:
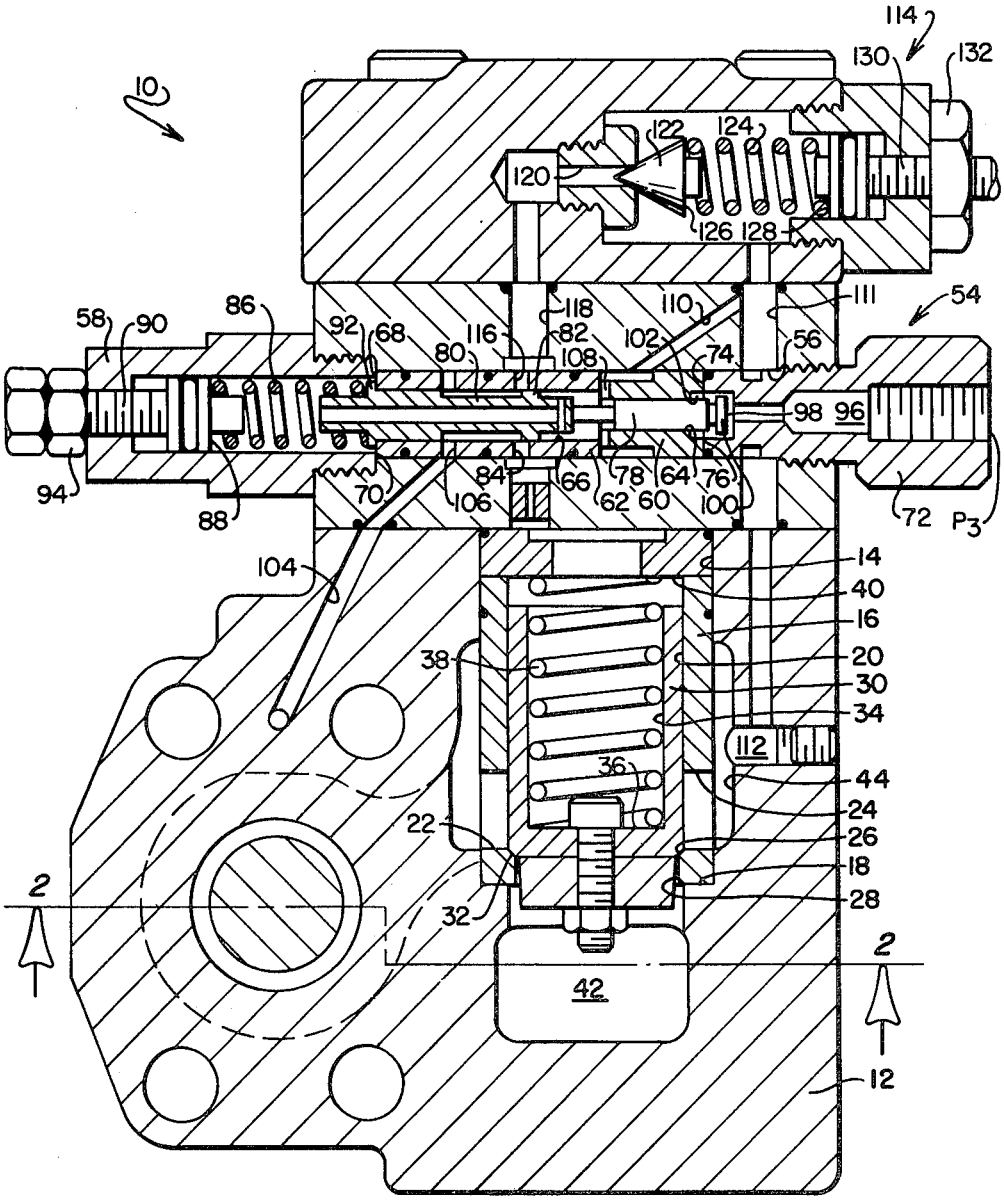
FIG. 1 is a cross-sectional view of the counterbalance valve of the instant invention along line 1—1 of FIG. 2.
Figure 2:
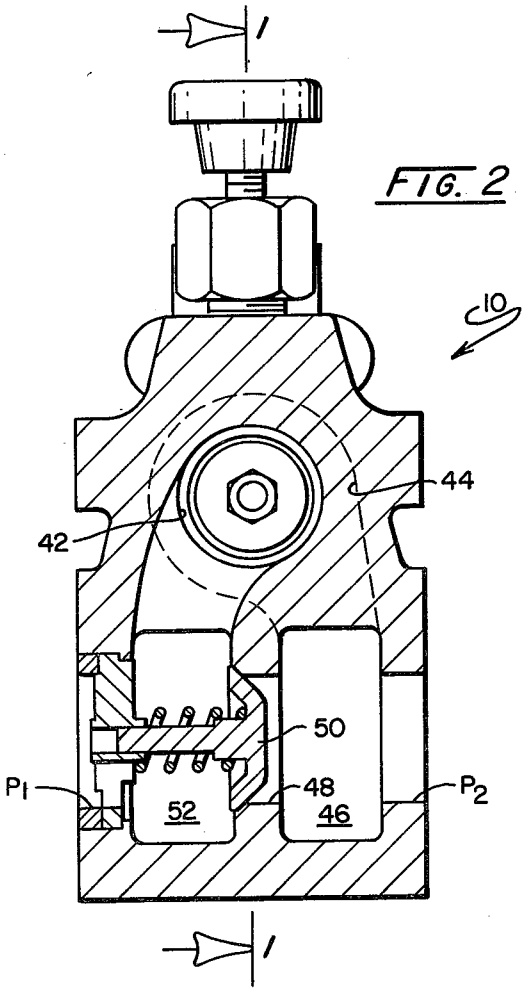
FIG. 2 is a view along line 2—2 of FIG. 1.

Referring to FIGS. 1 and 2 of the drawings, a counterbalance valve 10 has a body 12 which includes a sleeve bore 14. A sleeve 16 is inserted into bore 14 and is seated against a shoulder 18 at the bottom of the bore 14. Sleeve 16 has a longitudinal bore 20 and a pair of slots 22, 24 formed in the walls. One end of bore 20 terminates at a surface which tapers inwardly to form a seat 26. A reduced diameter bore 28 in one end of sleeve 16 defines the inner edge of the seat 26.

A control poppet 30 is inserted in bore 20. The bottom of poppet 30 has a tapered sealing surface 32 which complements the surface of seat 26 and forms a fluid-tight seal when the two surfaces are engaged. A control orifice which controls the flow of fluid from the inlet to the outlet of the counterbalance valve 10 when a load is lowered is formed between surface 32 and seat 26. A cylindrical spring bore 34, which terminates at a flat surface 36, is formed in one end of poppet 30. A spring 38, which acts between a surface 40 which defines one end of sleeve bore 14 and the flat surface 36 formed in bore 34, biases the poppet 30 against seat 26.

When poppet 30 is lifted from seat 26 the fluid in an inlet passage 42 beneath the poppet 30 is connected to a low pressure outlet passage 44 through the slots 22, 24 in sleeve 16. An inlet port P1 formed in the body of counterbalance valve 10 is connected to the inlet passage 42 and an outlet port P2 formed in the valve 10 is connected to outlet passage 44. Ports P1 and P2 are best seen in FIG. 2. It should be noted that the designations "inlet" and "outlet" for the passages 42, 44 and ports P1, P2 refer to the condition for controlled flow by the counterbalance valve 10 as when a load is lowered. In this condition, high pressure fluid enters port P1 and low pressure fluid is exhausted from port P2.

When the free flow of fluid through the valve 10 is desired, as when fluid is supplied to a motor to lift a load, pressure fluid is supplied to port P2. This fluid flows into a chamber 46 and through a bore 48 where it unseats a spring biased plunger 50 which acts as a check valve. After unseating the plunger 50, the fluid flows into a chamber 52 which opens into port P1. In this instance, port P2 is the high pressure port and port P1 is the low pressure port. Although the check valve 50 is shown in the counterbalance valve 10, it is not necessary to have the check valve integral with the counterbalance valve 10. The counterbalance valve 10 could be used in conjunction with an external check valve and the counterbalance valve 10 would operate to control the fluid exhausting from a fluid motor when a load is being lowered.

Referring to FIG. 1 of the drawings, the position of poppet 30 in bore 20 to set the opening of the control orifice and thereby set the rate of fluid of fluid from inlet passage 42 to outlet passage 44 is controlled by a pilot assembly 54. Pilot assembly 54 has a sleeve bore 56 formed in the counterbalance valve body 12 above the poppet 30. Sleeve bore 56 is closed at one end by a spring housing 58 which is threaded into bore 56. A pair of sleeves 60, 62 each having an axial piston bore 64, 66, respectively, are mounted in bore 56. One end 68 of sleeve 62 engages the end 70 of spring housing 58. This prevents the sleeves 60, 62 from moving to the left in bore 56. A pilot plug 72 is threaded into sleeve bore 56 to close the other end thereof. The end 74 of plug 72 engages one end 76 of sleeve 60 to thereby prevent movement of the sleeves 60, 62 to the right in bore 56.

A pair of pistons 78, 80 are slidably mounted in piston bores 64, 66 respectively. Piston 80 has a control land 82 which cooperates with a port 84 formed in sleeve 62. Port 84 is connected to the top of control poppet 30. A spring 86 in spring housing 58 acts between a shoulder 88 on an adjustment screw 90 and a shoulder 92 on one end of piston 80 to bias piston 80 to the right such that control land 82 is to the right of port 84. Shortly after control land 82 passes to the right of port 84, shoulder 92 on piston 80 engages the end 68 of sleeve 62 to prevent further travel of the piston 80. The position of adjustment screw 90 is set by a lock nut 94.

A stepped pilot fluid passage 96 is formed in pilot plug 72. A port P3 in the end of plug 72 receives pilot fluid, as will be described hereinafter. The passage 96 connects pilot fluid to the end 98 of the head 100 of piston 78. When pilot fluid acting on piston end 98 produces a force sufficient to overcome the force of spring 86 the pistons 78, 80 move to the left. Leftward movement of the pistons 78, 80 is sufficient to enable control land 82 to pass to the left of port 84. Further movement to the left is prevented by the engagement of head 100 with a shoulder 102 formed in sleeve 60.

In the instant valve 10, control land 82 overlaps port 84; i.e., it is wider than port 84. This enables piston 80 to move laterally a small amount in bore 66 without necessarily uncovering the port 84. Consequently, small changes in pilot pressure which cause small movement of the pistons 78, 80 will not disturb the setting of the control orifice. The amount of overlap can be changed to obtain the desired sensitivity of the valve 10.

The left side of control land 82 is exposed to high pressure inlet fluid when the counterbalance valve 10 is operating to control fluid flow. A fluid passage 104, which is connected with inlet passage 42 through a passage, not shown, supplies inlet pressure fluid to a bore 106 in sleeve 62 which opens into piston bore 66 to the left of control land 82. Piston bore 66 on the right side of control land 82 is connected to the low pressure outlet passage 44 through a bore 108 in sleeve 60 and fluid passages 110, 111 and 112.

The left side of control land 82 is also connected to a relief valve assembly 114 which sets the maximum allowable pressure of the inlet fluid. Bore 66 to the left of land 82 connects to assembly 114 through a bore 116 in sleeve 62, a fluid passage 118 and a bore 120. The end of bore 120 is closed by a cone 122. A spring 124 acting between a shoulder 126 on cone 122 and a shoulder 128 on an adjustment screw 130 biases the cone 122 to close the bore 120. The adjustment screw 130 acting on spring 124 provides the setting for relief valve 114. Adjustment screw 130 is retained in position by a lock nut 132.

Figure 3:
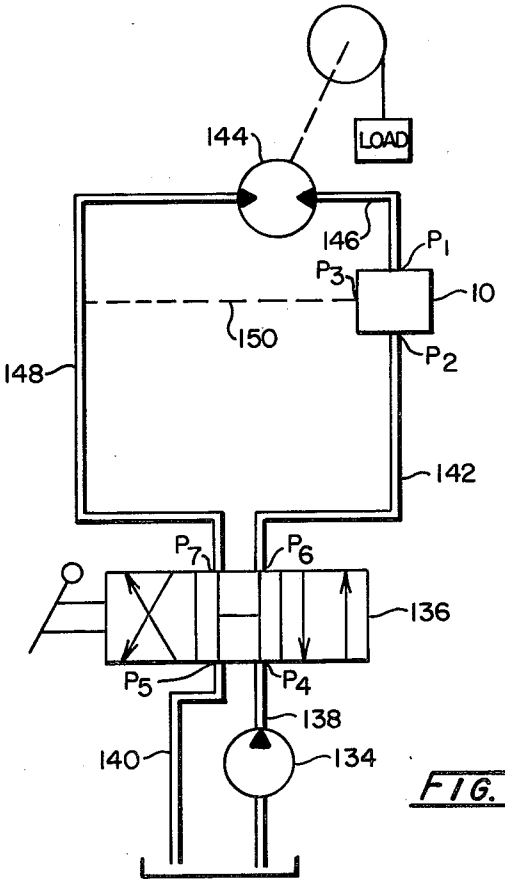
FIG. 3 shows the counterbalance valve connected to a hydraulic system for raising and lowering a load.

Counterbalance valve 10 is connected to a system in which the valve 10 controls the flow of fluid to and from a hydraulic motor which raises and lowers a load as follows. Referring in particular to FIG. 3, a pump 134 supplies fluid to an inlet or pressure port P4 of a four-way (open-center) valve 136 through a line 138. A port P5 of four-way valve 136 is connected to tank through a line 140. One outlet port P6 of four-way valve 136 is connected to port P2 of counterbalance valve 10 through a line 142. In the system, port P1 of counterbalance valve 10 is connected to a hydraulic motor 144 through a line 146. A second outlet port P7 of the four-way valve 136 is connected to hydraulic motor 144 through a line 148. A line 150 connects line 148 to the pilot port P3 of counterbalance valve 10.

When a load is raised, four-way valve 136 is shifted to the left such that pressure port P4 is aligned with outlet port P6 and pressure fluid is supplied through line 142 to counterbalance port P2. Pressure fluid in port P2 flows into chamber 46 through bore 48, past plunger 50 into chamber 52 and out of port P1. From port P1 the pressure fluid flows through line 146 to the motor 144 to raise the load. Fluid exhausted from motor 144 flows through line 148 into four-way valve port P7 which is connected to tank port P5. It can be seen that when a load is raised the counterbalance valve 10 of the instant invention does not control the fluid flow. The check valve 50 simply lets fluid flow through the counterbalance valve 10.

Operation of the counterbalance valve to control the flow of fluid from the hydraulic motor 144 when a load is lowered will now be described. When a load is lowered, four-way valve 136 is shifted to the right such that pressure port P4 is connected to outlet port P7 and outlet port P6 is connected to tank port P5. Pressure fluid from port P7 flows through line 148 to motor 144. The pressure fluid in line 148 also flows through line 150 to enter pilot port P3 of counterbalance valve 10. Pressure fluid exhausting from motor 144 flows through line 146 into port P1 of counterbalance valve 10. Counterbalance valve port P2 is connected to four-way valve port P6 through line 142, as described above. Since port P6 is connected to tank port P5, the pressure in port P2 is essentially case or tank pressure.

Referring to FIGS. 1–3, when a load is lowered pressure fluid is supplied to line 148. Pressure fluid exhausting from the motor 144 into counterbalance valve port P1 flows into chamber 52 and inlet passage 42 to the bottom of control poppet 30. Referring in particular to FIG. 1, when there is insufficient fluid pressure in pilot port P3, spring 86 maintains piston 80 in a position such that control land 82 is to the right of control port 84. As previously mentioned, the left side of control land 82 is connected to inlet passage 42. Consequently, inlet pressure fluid is supplied to the top of poppet 30 through control port 84. The inlet pressure fluid on top of poppet 30 in conjunction with spring 38 maintains the poppet 30 in the closed position.

When the pressure of the fluid supplied to line 148 to supply the motor 144 and to line 150 connected to pilot port P3 applies a sufficient force on piston 78 to overcome the force of spring 86, the pistons 78, 80 shift to the left. Typically, spring 86 is sized such that the pressure in port P3 must be several hundred psi before the pistons 78, 80 can move. This is because many hydraulic motors in load lowering and raising circuits incorporate a spring-applied, pressure-released brake to hold a load in a set position. A pressure of several hundred psi is commonly required to release this type of brake. Consequently, spring 86 is sized to require a pressure in port P3 greater than that required to release the brake, since the brake must be released before the motor can turn.

When the pistons 78, 80 are shifted to the left, control land 82 is moved to the left of control port 84 and port 84 is connected to low outlet pressure. This reduces the pressure on top of poppet 30 and the fluid at inlet pressure acting on the bottom of poppet 30 is sufficient to overcome the force of spring 38 and lift poppet 30 off of seat 26. When fluid starts to flow through the control orifice between seat 26 and the bottom of poppet 30, the motor 144 turns to lower the load and the pressure in lines 148 and 150 begins to fall. When the pressure in pilot port P3 falls sufficiently, the force of spring 86 will overcome the force of the pilot fluid acting on piston 78 and pistons 78, 80 will be moved to the right, such that control land 82 covers control port 84.

In the event that the load starts to cause motor 144 to overspeed, the pressure in lines 148 and 150 and pilot port P3 will fall enough to allow spring 86 to move pistons 78, 80 to the right such that control land 82 moves to the right of control port 84. When this occurs, inlet pressure fluid is supplied to the top of poppet 30 which acts with spring 38 to move the poppet 30 toward seat 26 and reduce the amount of flow through the control orifice. This slows the speed of motor 144 and increases the pressure in lines 148, 150 and port P3 until the pressure is sufficient to shift pistons 78, 80 to the left and control land 82 covers port 84.

From the above, it can be seen that rising or falling pressures in lines 148, 150 and port P3 due to slowing down or speeding up of motor 144 will cause pistons 78, 80 and control land 182 to move such that port 84 is connected to low or high pressure fluid in order to increase or decrease the opening of the control orifice.

Frequently, it is necessary to stop a load which is in the process of being lowered. In order to stop the movement of the hydraulic motor 144, the four-way valve 136 is shifted to the center position. When this occurs, pressure in lines 148, 150 and port P3 falls to tank pressure and spring 86 shifts control land 82 to the right of port 84 to thereby cause the high pressure fluid to flow to the top of poppet 30 and cooperate with spring 38 to move the poppet 30 against its seat 26. Since the movement of poppet 30 against seat 26 can occur quite rapidly, it is possible for the inertia of the load to cause a momentary high pressure surge to occur in the fluid inlet passage 42. If the pressure in this passage 42 were allowed to go to an uncontrolled level, some of the components of the hydraulic system could be damaged. In the counterbalance valve 10 of the instant invention, momentary high pressure surges are prevented by relief valve 114. As previously mentioned, the left side of control land 82 is connected to a relief valve 114. Adjustment screw 130 and spring 124 are set such that fluid in bore 120 will unseat cone 122 when the pressure in the inlet passage 42 and fluid passages 104, 118 reach a predetermined amount. In this way, momentary high pressure surges are prevented.

Although a preferred embodiment of the invention has been illustrated and described, it will be apparent to those skilled in the art that various modifications may be made without departing from the spirit and scope of the present invention.

We claim:

1. A counterbalance valve for controlling the flow of high pressure fluid from a hydraulic motor which moves a load and is driven by a pump having an inlet and an outlet comprising a valve body, a fluid inlet in the body, a fluid outlet in the body, means for connecting the outlet of the motor to the fluid inlet whereby the motor supplies pressure fluid to the fluid inlet, a first fluid passage which connects the inlet and the outlet, a poppet bore, a seat, a poppet movable in the bore between a first setting in which the poppet engages the seat and blocks the first fluid passage and a second setting in which the poppet is spaced from the seat and cooperates with the seat to open the first fluid passage and form a control orifice through which pressure fluid flows from the inlet to the outlet, and spring means for biasing the poppet into the said first setting, characterized by a second fluid passage connected to the top of the poppet, a control port at the entrance to the second fluid passage, means for connecting the control port to pressure fluid in the fluid inlet, second means for connecting the control port to the fluid outlet, a pilot valve movable between a first position in which the control port is open to receive inlet pressure fluid, a second position in which the control port is blocked and a third position in which the control port is open to the fluid outlet, second spring means for biasing the pilot valve into the first position, a pilot port connected to the pilot valve, and means for connecting the pump outlet to the pilot port, wherein the pilot port receives pressure fluid from the pump to bias the pilot valve into the third position when the pump drives the motor and the counterbalance valve begins to operate to thereby open the control orifice to permit fluid to flow from the fluid inlet to the fluid outlet, and the pilot valve moves in response to changes in the pressure of the fluid in the pilot port alternatively between the first and third positions to modulate the opening of the control orifice and control the flow of pressure fluid from the hydraulic motor and the pilot valve remains in the second position and the control orifice maintains its opening when the pilot pressure is constant.

2. The counterbalance valve of claim 1, further characterized by a pilot bore, the pilot valve including a pilot spool slidable in the pilot bore and a control land on the pilot spool, the control port opening into the pilot bore and the control land overlapping the control port when the pilot valve is in the second position so that small changes in pressure of the fluid in the pilot port with resulting small movements of the pilot spool do not cause the control land to uncover the control port.

3. The counterbalance valve of claim 1, further characterized by a pilot bore, the pilot valve including a pilot spool slidable in the pilot bore, and a control land on the pilot spool wherein the pilot port opens into the pilot bore to supply pressure fluid from the pump to one side of the control land.

* * * * *